US008118381B2

(12) United States Patent
Katoh

(10) Patent No.: US 8,118,381 B2
(45) Date of Patent: Feb. 21, 2012

(54) IMAGE FORMING APPARATUS

(75) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/185,674

(22) Filed: Jul. 19, 2011

(65) Prior Publication Data

US 2011/0273506 A1 Nov. 10, 2011

Related U.S. Application Data

(63) Continuation of application No. 12/365,287, filed on Feb. 4, 2009, now Pat. No. 8,016,375.

(30) Foreign Application Priority Data

Mar. 7, 2008 (JP) ..... 2008-057348

(51) Int. Cl.
*B41J 29/38* (2006.01)

(52) U.S. Cl. ..... 347/6; 347/17

(58) Field of Classification Search ..... 347/6–7, 347/17, 93, 95

See application file for complete search history.

(56) References Cited

U.S. PATENT DOCUMENTS

| | | | | |
|---|---|---|---|---|
| 6,374,769 | B1 * | 4/2002 | Pesavento et al. | 118/46 |
| 6,682,185 | B2 | 1/2004 | Hashimoto et al. | |
| 6,824,241 | B2 * | 11/2004 | Sonnichsen et al. | 347/20 |
| 6,913,348 | B2 | 7/2005 | Hashimoto et al. | |
| 7,325,908 | B2 | 2/2008 | Katoh et al. | |
| 7,360,882 | B2 * | 4/2008 | Ikeda et al. | 347/92 |
| 7,364,253 | B2 | 4/2008 | Hashimoto et al. | |
| 7,380,927 | B2 | 6/2008 | Shigemura | |
| 2006/0048647 | A1 | 3/2006 | Iwata | |
| 2007/0008356 | A1 | 1/2007 | Katoh | |
| 2008/0158294 | A1 | 7/2008 | Katoh | |

FOREIGN PATENT DOCUMENTS

| | | |
|---|---|---|
| JP | 2006-75662 | 3/2006 |
| JP | 2006-181949 | 7/2006 |

* cited by examiner

*Primary Examiner* — Jason Uhlenhake

(74) *Attorney, Agent, or Firm* — Cooper & Dunham LLP

(57) ABSTRACT

An image forming apparatus includes a recording head configured to jet a liquid; a liquid tank configured to store the liquid; and a supply tube having flexibility, the supply tube being provided between the liquid tank and the recording head, wherein the supply tube includes a first flow path through which the liquid flows from the liquid tank to the recording head, and a second flow path surrounding the first flow path, the second flow path being a path through which a temperature control liquid flows, the temperature control liquid controlling a temperature of the liquid flowing through the first flow path.

8 Claims, 21 Drawing Sheets

IMAGE FORMING APPARATUS

CROSS-REFERENCE TO RELATED APPLICATIONS

This application is a Rule 1.53(b) continuation of application No. 12/365,287, tiled Feb. 4, 2009 now U.S. Pat. No. 8,016,375, the entire contents of which are incorporated by reference herein.

BACKGROUND OF THE INVENTION

1. Field of the Invention

The present invention generally relates to image forming apparatuses, and more specifically, to an image forming apparatus having a recording head configured to jet a liquid drop.

2. Description of the Related Art

As an image forming apparatus such as a printer, facsimile, copier, plotter, or a multiple function processing machine including the printer, facsimile, copier, and the plotter, an inkjet recording apparatus is known. The inkjet recording apparatus is a liquid jet recording type image forming apparatus using a recording head configured to jet an ink liquid drop.

In this liquid jet recording type image forming apparatus, the ink liquid drop is jetted from the recording head onto a conveyed sheet so that image forming such as recording or printing is performed. In the liquid jet recording type image forming apparatus, there are two kinds of image forming apparatuses. One is a serial type image forming apparatus configured to jet a liquid drop so that an image is formed while a recording head moves in a main scanning direction. The other is a line type image forming apparatus using a line type head whereby a liquid drop is jetted while the recording head does not move so that an image is formed.

Hereinafter, the "image forming apparatus" means an apparatus configured to jet liquid onto a medium such as a paper, thread, fiber, leather, hides, metal, plastic, glass, wood, or ceramic so that images are formed. The image forming apparatus includes a mere liquid jetting apparatus. In addition, "image forming" means not only providing an image of characters, figures, or the like on the medium but also providing an image such as a pattern having no meaning on the medium. "Image forming" includes adherence of the liquid drop onto the medium.

Furthermore, "ink" is not limited to the recording liquid or the ink and any liquid that is a fluid when being jetted can be applied to the liquid such as fixing liquid. In addition, "sheet" is not limited to a paper but includes an OHP sheet or leather. In other words, the sheet means a subject where the ink drop is adhered. The sheet includes a recorded medium, a recording medium, a recording paper, and a recording sheet.

As a liquid jetting head (liquid drop jetting head) used as a recording head, a piezo-electric type head or a thermal type head are known. In the piezo-electric type head, a vibration plate is displaced by a piezo-electric actuator and the volume in a liquid room is changed so that pressure is increased whereby a liquid drop is jetted. In the thermal type head, a heating element for heating based on electrification is provided in the liquid room so that the pressure in the liquid room is increased by air bubbles generated by heating with the heater whereby the liquid is jetted.

In the above-mentioned liquid jet type image forming apparatus, increasing the number of nozzles or heads has been attempted for accomplishing high speed printing.

Recently, a line type image forming apparatus has been suggested where plural short heads are joined so that a long head array unit is formed whereby an image can be formed without making the head scan. In addition, as a way for responding to the high speed requirement, it has been suggested that the ink jet frequency be increased.

However, increasing the number of nozzles or high speed driving encourages temperature increase of the head. That is, when the temperature of the head is increased, the temperature of the ink inside the head is increased. As a result of this, viscosity of the ink is changed so that jetting properties of the head are influenced. Because of this, in the conventional image forming apparatus, an ink jetting signal or the like is controlled based on the temperature of the head in order to maintain the jetting state constant.

However, in a case where a head array unit having a large number of the nozzles is driven at high speed, since the temperature increase is drastic, it is not possible to adequately respond by only controlling the ink jetting signal.

For example, Japanese Laid-Open Patent Application No. 2006-181949 suggests the following techniques. That is, inside a fixing member configured to support a head board of a line head as a head array unit, an independent liquid path is provided from a common liquid room where jetting liquid is supplied. With this structure, the liquid is circulated so that the temperature of the head is maintained constant.

However, in the apparatus suggested in Japanese Laid-Open Patent Application No. 2006-181949, ink and a liquid substance different from the ink are respectively supplied to the head part via a large number of tubes. Accordingly, the tube structure is complex. In addition, only the temperature of the head can be controlled by the liquid substance.

SUMMARY OF THE INVENTION

Accordingly, embodiments of the present invention may provide a novel and useful image forming apparatus solving one or more of the problems discussed above.

More specifically, the embodiments of the present invention may provide an image forming apparatus whereby temperature of a recording head can be controlled with a simple tube structure and high efficiency.

One aspect of the present invention may be to provide an image forming apparatus including:

a recording head configured to jet a liquid;

a liquid tank configured to store the liquid; and a supply tube having flexibility, the supply tube being provided between the liquid tank and the recording head, wherein the supply tube includes

- a first flow path through which the liquid flows from the liquid tank to the recording head, and
- a second flow path surrounding the first flow path, the second flow path being a path through which a temperature control liquid flows, the temperature control liquid controlling a temperature of the liquid flowing through the first flow path.

Additional objects and advantages of the embodiments are set forth in the description which follows, and may become obvious from the description or may be learned by practice of the invention. The object and advantages of the embodiments may be realized and attained by means of the elements and combinations particularly pointed out in the appended claims.

It is to be understood that both the foregoing general description and the following detailed description are exemplary and explanatory only, and are not restrictive of the invention as claimed.

BRIEF DESCRIPTION OF THE DRAWINGS

A more complete appreciation of the invention and many of its attendant advantages may be readily obtained through better understanding by reference to the following detailed description when considered in connection with the accompanying drawings, wherein.

DETAILED DESCRIPTION OF THE PREFERRED EMBODIMENTS

A description is given below, with reference to the FIG. 1 through FIG. 25 of embodiments of the present invention.

Figure 1:
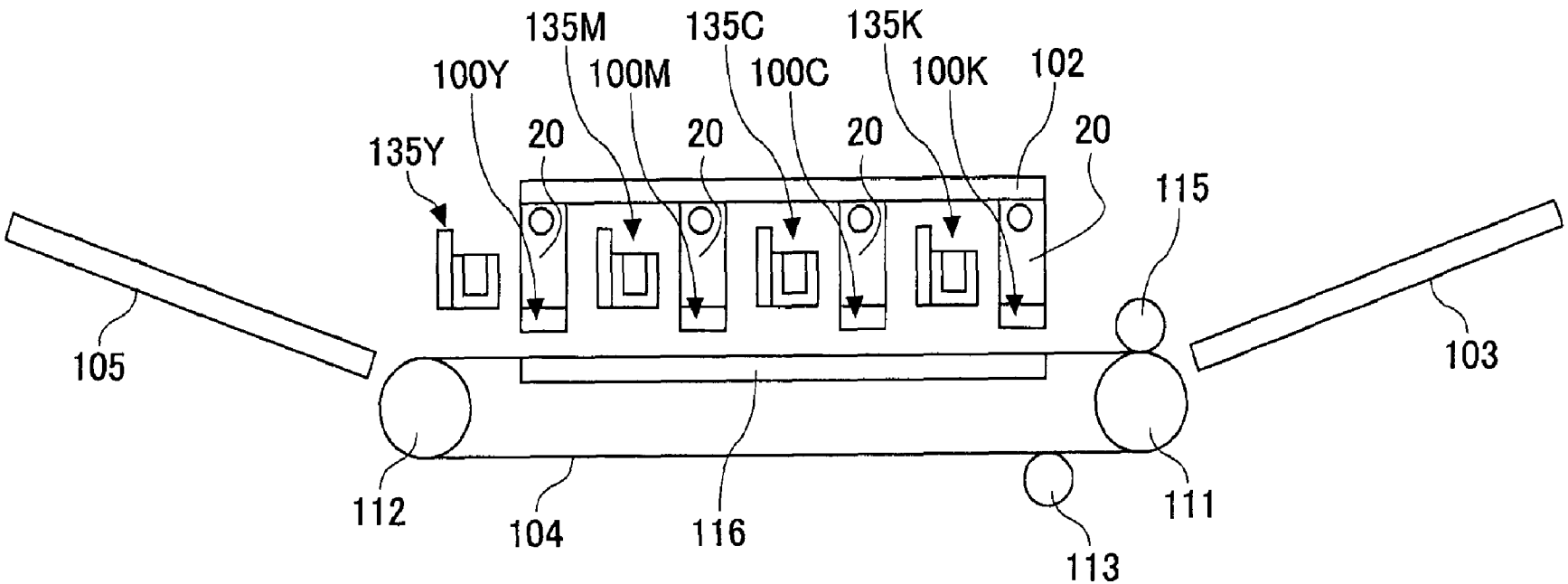
FIG. 1 is a schematic structural view of an image forming apparatus of a first embodiment of the present invention.

An image forming apparatus of a first embodiment of the present invention is discussed with reference to FIG. 1. Here, FIG. 1 is a schematic structural view of the image forming apparatus of the first embodiment of the present invention.

This image forming apparatus is a line printer where four recording heads 100 (100K, 100C, 100M, 100Y) are provided for inks of four different colors (black, cyan, magenta, yellow). The recording heads 100 (100K, 100C, 100M, 100Y) have widths corresponding to a maximum width of a paper to be conveyed. Four recording heads 100 are fixed to a head frame 102. Four recording heads 100 are configured to be moved upward and downward simultaneously by a head elevating mechanism not shown in FIG. 1.

A recording paper is conveyed just below the recording heads 100 (100K, 100C, 100M, 100Y). An image is recording on the recording paper by jetting ink. The recording papers are stored in a paper feeding tray 103. Each of the recording papers is transferred by a separating paper feeding mechanism not shown in FIG. 1 and conveyed by a paper feeding belt 104. After recording is completed, each of the recording papers is discharged to a paper discharging tray 105.

A paper conveyance belt 104 is bridged between a belt conveyance roller 111 and a tension roller 112. The paper conveyance belt 104 has a double layer structure having a front surface layer and a rear surface layer. The front surface layer is a high resistance layer made of a resin material. The rear surface layer is a middle resistance layer where resistance of a resin material is controlled by carbon.

A charging roller 113 comes in contact with the paper conveyance belt 104. The charging roller 113 has a structure where a middle resistance layer is formed as an external layer of a metal roller and a relatively high resistance layer is formed as a most external layer. In addition, a pushing roller 115 is provided so as to face the conveyance roller 111 via the paper conveyance belt 104. A platen member 116 is arranged at a rear surface side of an image forming area for the recording heads 100 of the paper conveyance belt 104.

Under this structure, when a high voltage is applied to the charging roller 113, an electric discharge is generated due to an air gap situated in the vicinity of a nip part formed by the paper conveyance belt 104 and the charging roller 113, so that charges are adhered on the paper conveyance belt 104.

When a voltage applied to the charging roller 113 is a positive and negative alternating voltage, positive and negative charges are adhered on the paper conveyance belt 104 in a stripe pattern.

When the recording paper is supplied to the charged paper conveyance belt 104, the recording paper is attracted onto the paper conveyance belt 104 due to an electrostatic force. Since printing can be performed when the recording paper is tightly held by the paper conveyance belt 104 even while the paper is conveyed at high speed, it is possible to achieve stable printing quality.

Figure 2:
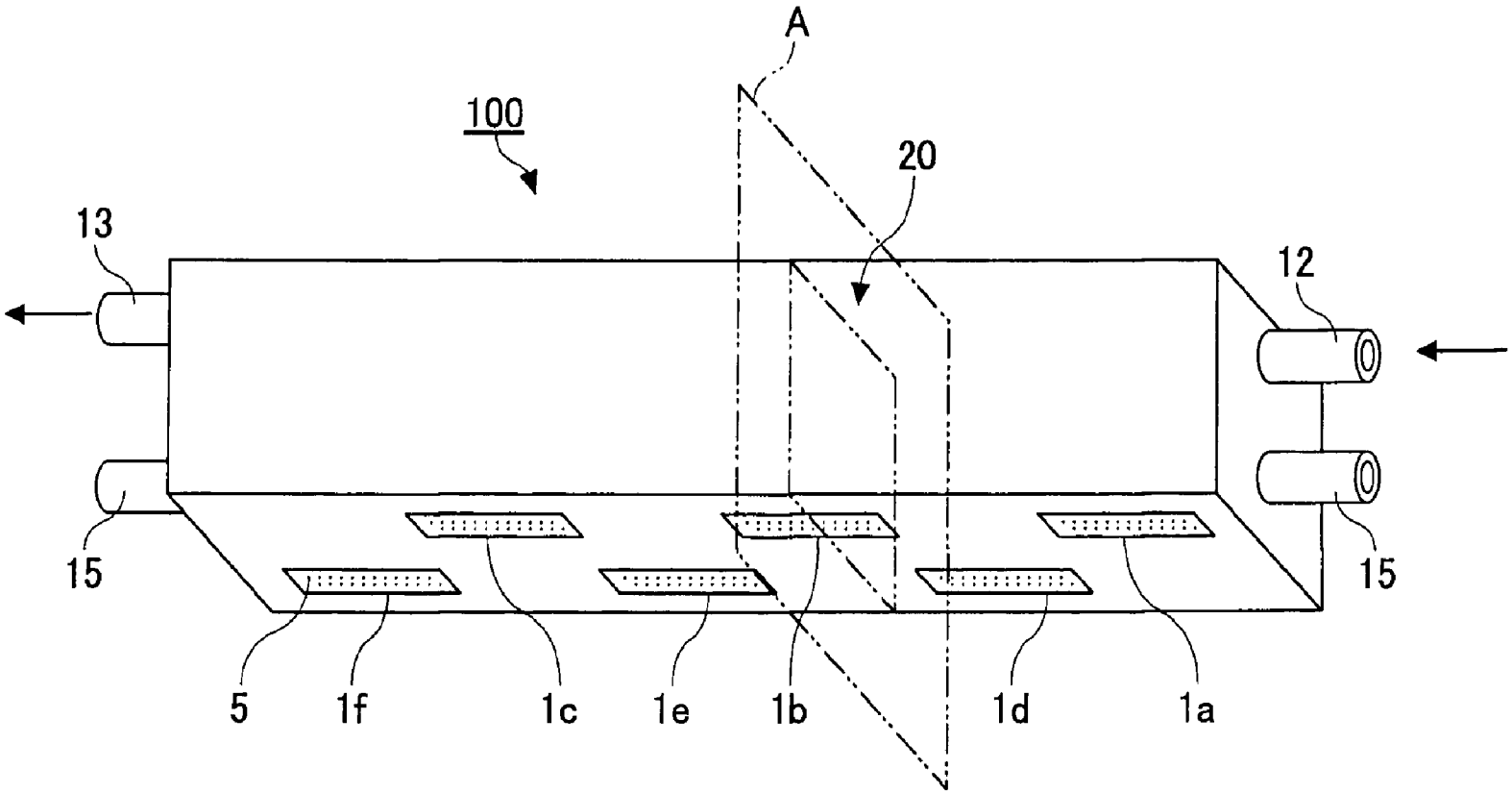
FIG. 2 is perspective view showing an example of a recording head of the image forming apparatus of the first embodiment of the present invention.
Figure 3:
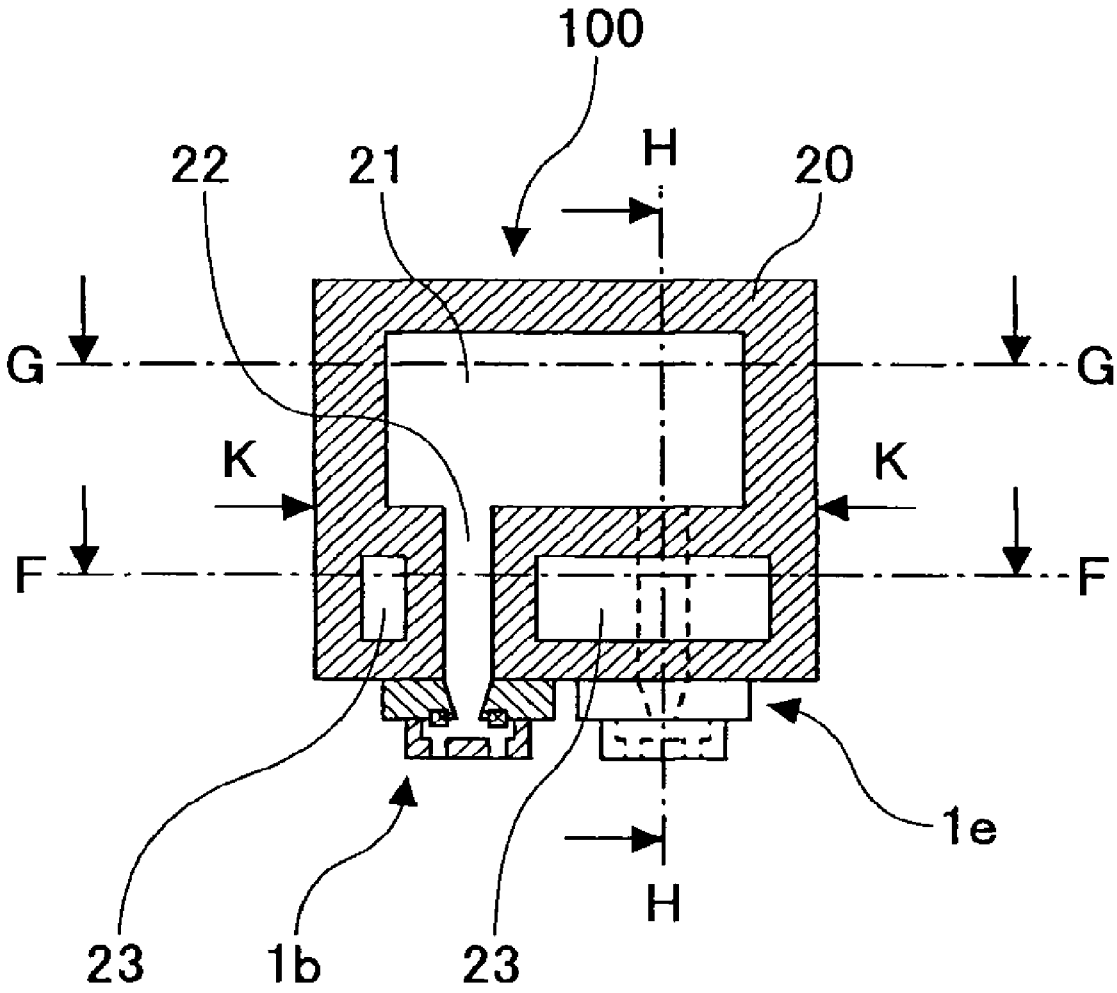
FIG. 3 is a cross-sectional view taken along a two dotted line A of FIG. 2.
Figure 4:
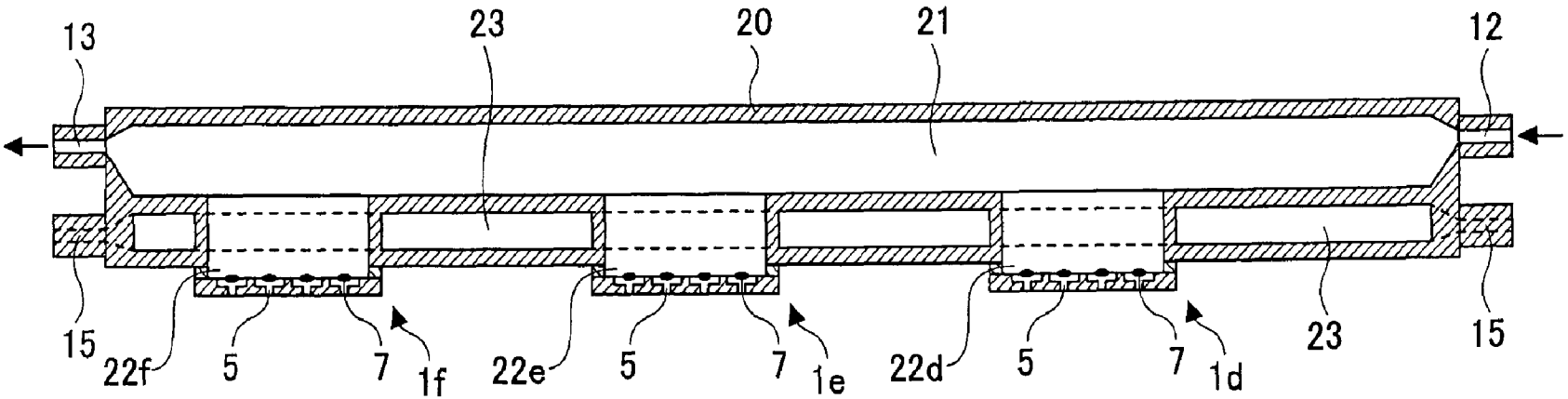
FIG. 4 is a cross-sectional view taken along a one dotted line H of FIG. 3.
Figure 5:
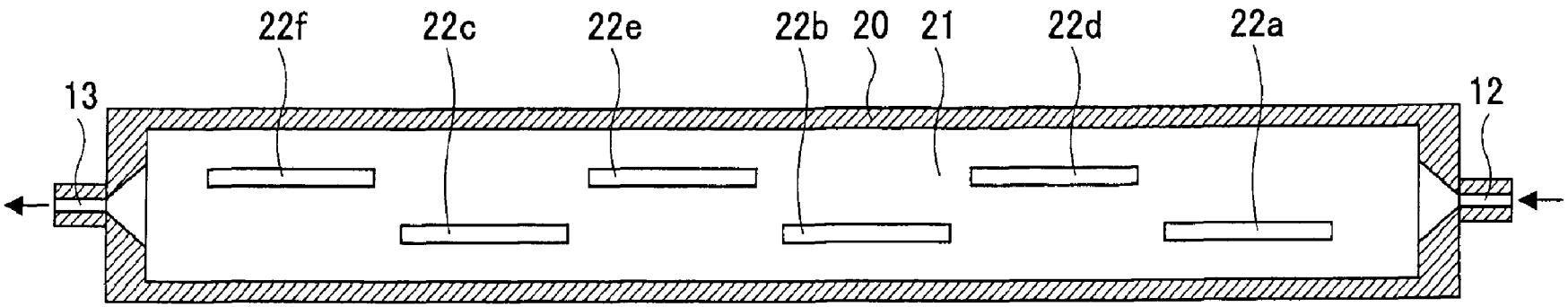
FIG. 5 is a cross-sectional view taken along a one dotted line G of FIG. 3.
Figure 6:
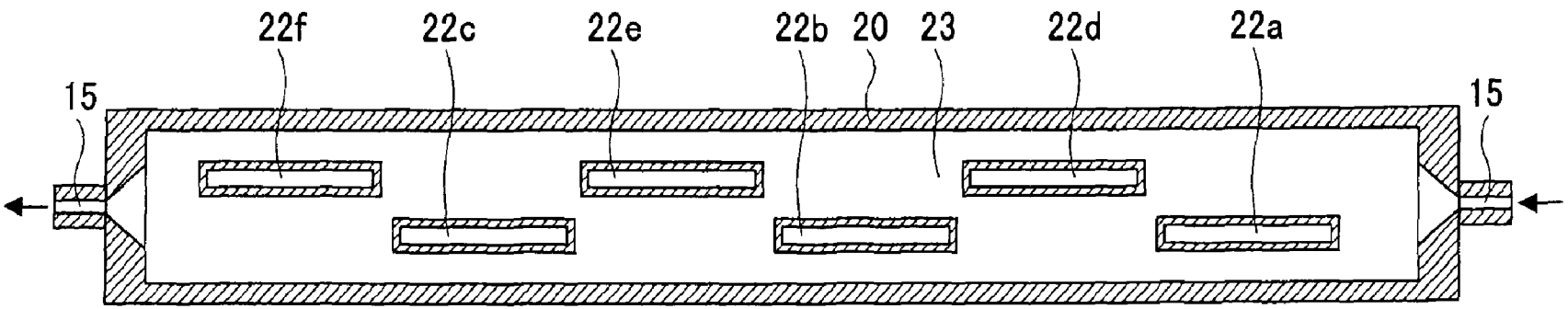
FIG. 6 is a cross-sectional view taken along a one dotted line F of FIG. 3.
Figure 7:
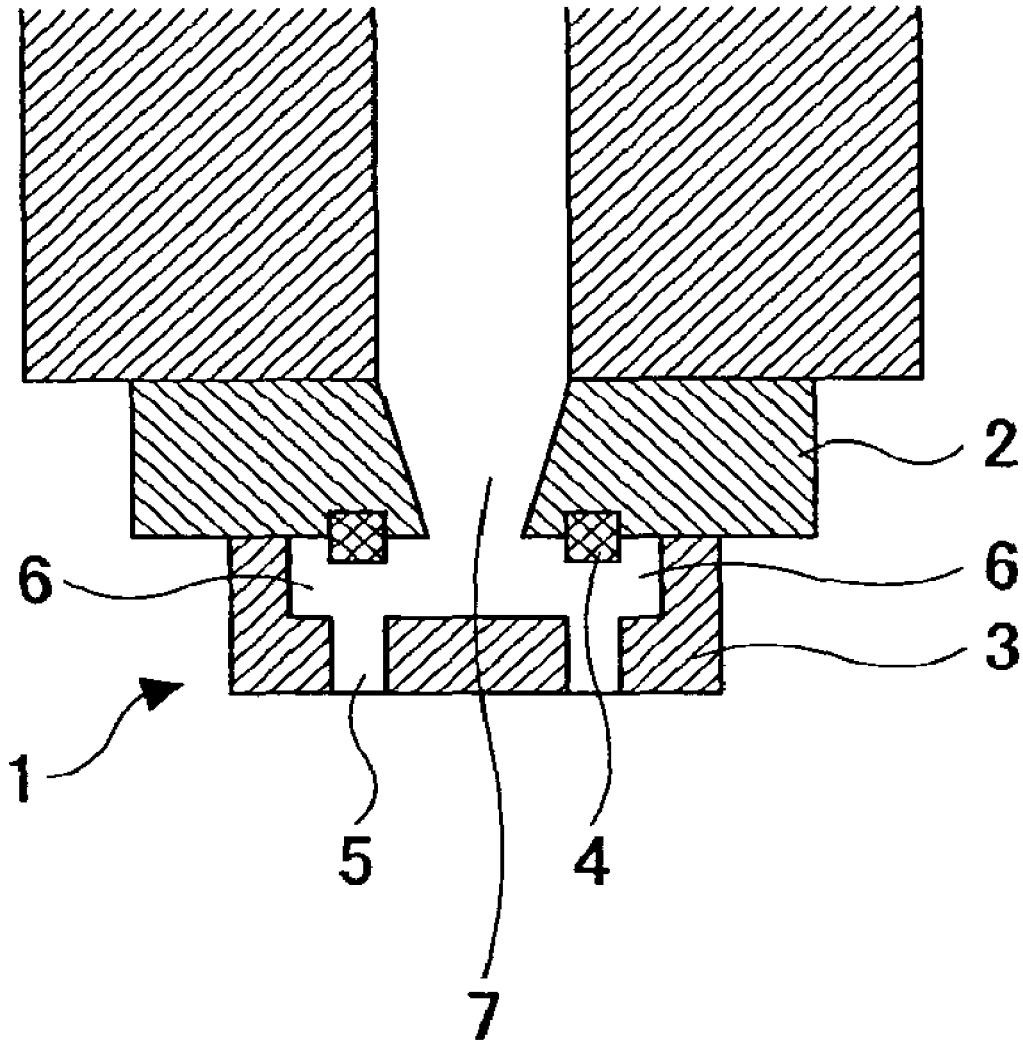
FIG. 7 is an expanded view of a main part of a liquid jet head.

Next, an example of the recording heads of the image forming apparatus of the first embodiment of the present invention is discussed with reference to FIG. 2 through FIG. 7. Here, FIG. 2 is perspective view showing an example of the recording heads of the image forming apparatus of the first embodiment of the present invention. FIG. 3 is a cross-sectional view taken along a two-dotted line A of FIG. 2. FIG. 4 is a cross-sectional view taken along a one-dotted line H of FIG. 3. FIG. 5 is a cross-sectional view taken along a one-dotted line G of FIG. 3. FIG. 6 is a cross-sectional view taken along a one-dotted line F of FIG. 3. FIG. 7 is an expanded view of a main part of a liquid jet head.

In the recording head 100, plural (six in this example) short liquid jet heads la through if (hereinafter "liquid jet head 1")

are arranged in a head longitudinal direction so as to be offset alternately in a direction perpendicular to the head longitudinal direction. In other words, the recording head 100 is a line type head having a head array unit structure fixed to the head fixing member 20 in a zigzag manner. It should be noted that the number of the liquid jet heads 1 is not limited to this example.

As shown in FIG. 7, the liquid jet head 1 is a thermal type head and includes a heating element board 2 and a flow path board 3. Plural nozzles 5 configured to jet liquid drops and plural individual liquid rooms 6 in communication with the nozzles 5 are provided at the flow path board 3. Heating elements 4 corresponding to the individual liquid rooms 6 are provided at the heating element board 2. An electrification part such as an FPC not shown in FIG. 7 is connected to the heating element board 2. The heating element 4 is driven by inputting a pulse voltage to the heating element 4 via the electrification part. As a result of this, film boiling is generated in the liquid in the individual liquid room 6 so that a liquid drop is jetted from the nozzle 5.

In this embodiment, as shown in FIG. 3 and FIG. 7, two nozzle lines where plural nozzles 5 are arranged in the head longitudinal direction are formed. Liquid is supplied from a common liquid room provided in the center of the heating element board 2 as shown in FIG. 3 and FIG. 4 to the individual liquid rooms 6 corresponding to the nozzles 5.

In this example, a side shooter type structure is provided. In this structure, the direction of ink flow to a jet energy action part (heating element part) in the liquid room 6 and an opening central axis of the nozzle 5 are perpendicular to each other. In this structure, it is possible to efficiently convert energy from the heating element 4 to kinetic energy for forming the ink drop and jetting the ink drop. In addition, reforming a meniscus due to supplying the ink is speedy. Hence, this structure is proper for high speed driving.

In addition, corresponding to an opening forming the common liquid room 7 of the heating element boards 2 (see FIG. 7) of six liquid jet heads 1, as shown in FIG. 3 and FIG. 4, a head fixing member 20 is connected to the liquid jet heads 1. The head fixing member 20 is configured to supply the liquid to the common liquid room 7. Although the liquid jet heads 1 are directly connected to the head fixing member 20 in this embodiment, other members such as a spacer plate may be provided between the head fixing member 20 and the liquid jet heads 1.

A liquid supply path 21 is formed inside the head fixing member 20. The liquid supply path 21 is configured to supply the liquid to all six liquid jet heads 1. A supply port 12 and a discharge port 13 are formed at end parts of the liquid supply path 21 in the longitudinal direction. The supply port 12 is configured to supply liquid and the discharge port 13 is configured to discharge the liquid. The liquid is supplied to the common liquid room 7 of the liquid jet head 1 via a liquid supply opening 22 in communication with the liquid supply path 21.

As discussed below, the head fixing member 20 is provided in a liquid supply path (not shown) so that the liquid flows from the supply port 12 to the discharge port 13 via the liquid supply path 21 and is circulated. In addition, an arrow pointing toward the supply port 12 and an arrow pointing from the discharge port 13 toward outside respectively indicate a flow-in direction and a discharge direction of the liquid.

A temperature control fluid flow path 23 is provided inside the head fixing member 20. A temperature control fluid (temperature control liquid) flows through the temperature control fluid flow path 23. The temperature control fluid is configured to control the temperature of the recording head 100. Temperature control fluid ports 15 in communication with the temperature control fluid path 23 are provided at both end parts of the head fixing member 20 in the longitudinal direction. As shown in FIG. 3 and FIG. 6, the temperature control fluid path 23 is provided so as to surround the periphery of the liquid supply openings 22 of the liquid jet heads 1. The temperature control fluid flows through the temperature control fluid path 23 by using the temperature control fluid ports 15. As discussed above, the temperature control fluid path 23 is provided between the liquid supply path 21 and the liquid jet heads 1. Accordingly, it is possible to efficiently control the temperatures of the liquid in the liquid supply path 21 and the liquid jet heads 1 at desirable temperatures. Therefore, even if the above-mentioned thermal type liquid jet heads 1 are driven at high speed, it is possible to jet the liquid in a stable manner without problems due to heat accumulation.

In the meantime, while a pipe has a rectangular cross section in this embodiment, the present invention is not limited to this example. For example, the pipe may have a trapezoidal cross section with a long side at the recording head side is so that it is possible to achieve high temperature changing efficiency.

Furthermore, it is preferable that a part forming the temperature control fluid flow path 23 be made of a material having high thermal conductivity. In the case where the part forming the temperature control fluid flow path 23 is made of the material having the high thermal conductivity such as metal, heat generated from the liquid jet heads 1 is effectively transferred so that heat accumulation in the recording head 100 can be prevented.

As a material having a high coefficient of thermal conductivity, resin including thermal conductive filler such as silica, alumina, boron nitride, magnesia, aluminum nitride, or silicon nitride may be used. When the resin material is used, it is possible to form the temperature control fluid path 23 in a body with each port or the liquid supply path 21 and therefore productivity is improved. In addition, foam metal such as an SUS (having, for example, a preliminary diameter of 600 μm and a porosity of approximately 95%) is proper as a material for the temperature control fluid path 23 because the surface area in contact with the temperature control fluid becomes large. In addition, a part fixing the heads 1 of the head fixing member 20 or a part forming the temperature control fluid path 23 may be made of a high thermal conductivity material such as metal or may be stacked by forming an inexpensive resin molded article as the liquid supply path 21.

Figure 8:
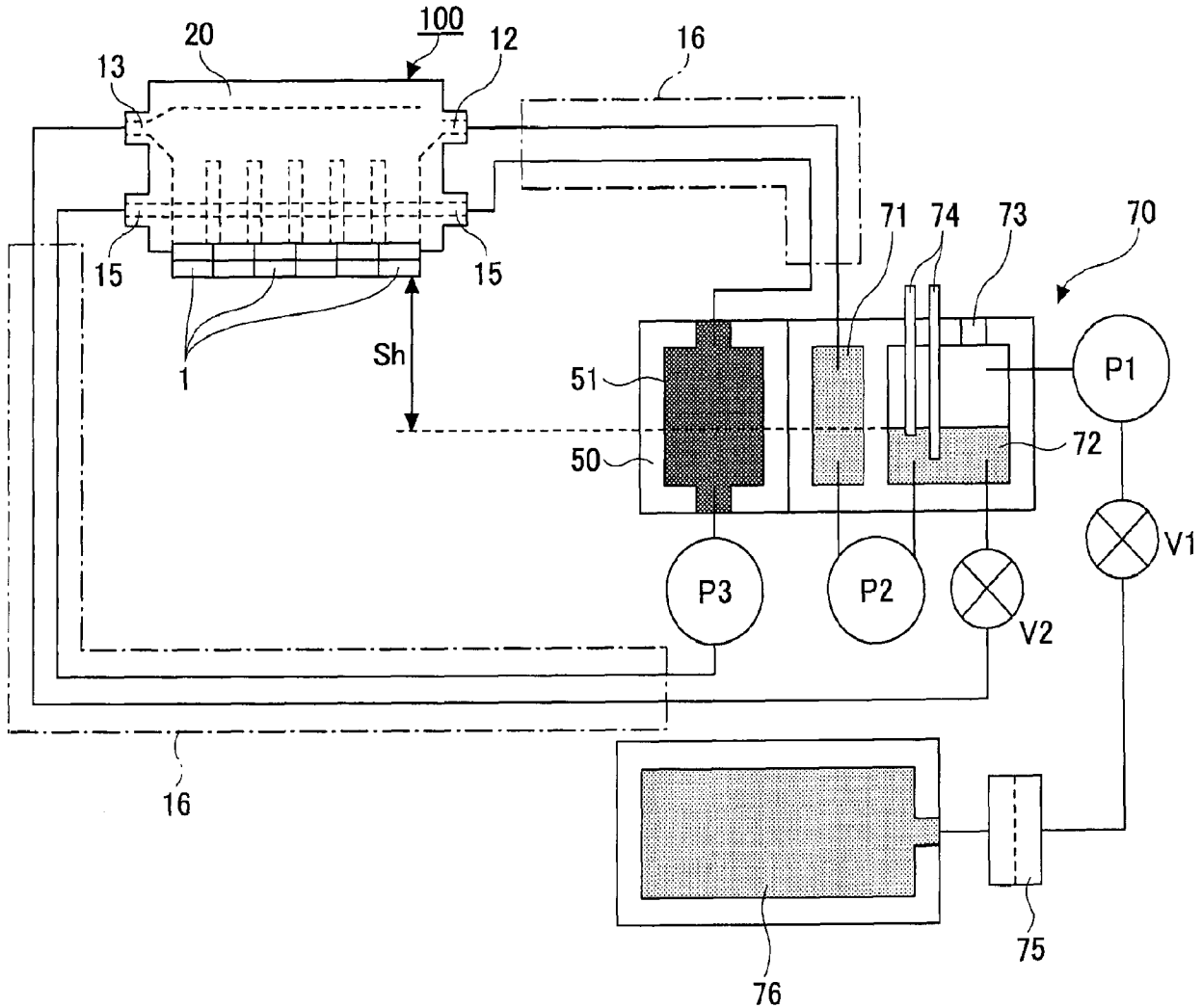
FIG. 8 is a schematic view of a supply path of ink and temperature control liquid of the image forming apparatus of the first embodiment of the, present invention.

Next, a supply system of the ink (liquid) and the temperature control liquid in the image forming apparatus is discussed with reference to FIG. 8. FIG. 8 is a schematic view of the supply path of the ink and the temperature control liquid of the image forming apparatus of the first embodiment of the present invention.

An ink tank 70 is configured to supply the ink to the recording head 100, and receive air bubbles and discharge them outside. The inside of the ink tank 70 is divided into a first ink room 71 and a second ink room 72 having an air opening 73 situated at an upper part of the second ink room 72. The ink can be moved from the second ink room 72 to the first ink room 71 by a pump P2.

An ink cartridge 76 is connected to the second ink room 72. The ink filtered by a filter 75 can be supplied to the second ink room 72 of the head tank 70 by a pump P1.

An ink port is provided at a bottom surface of the second ink room 72 of the ink tank 70. The ink port is connected to the discharge port 13 of the head fixing member 20 of the recording head 100 via a valve V2 which is normally open. In addition, the amount of the ink in the second ink room 72 is controlled based on detection results of a liquid position detection sensor 74 so that the difference of heads Sh of the ink liquid surface in the second ink room 72 and a nozzle surface of the liquid jet heads 1 of the recording head 100 is a constant value such as 10 mm through 150 mm.

Here, in a case of normal image forming, the pumps P1 and P2 are stopped and only the valve V2 is open. The ink is supplied from the second ink room 72 to the head array unit 100 via the discharge port 13. When the position of the liquid surface of the second ink room 72 becomes lower than a designated position due to ink consumption, this is detected by the liquid position detection sensor 74. In this case, the valve V1 is opened and the pump P1 is operated so that the ink is supplied from the ink cartridge 76 to the second ink room 72. Stopping the supplying is controlled by using the liquid position detection sensor 74.

Figure 9:
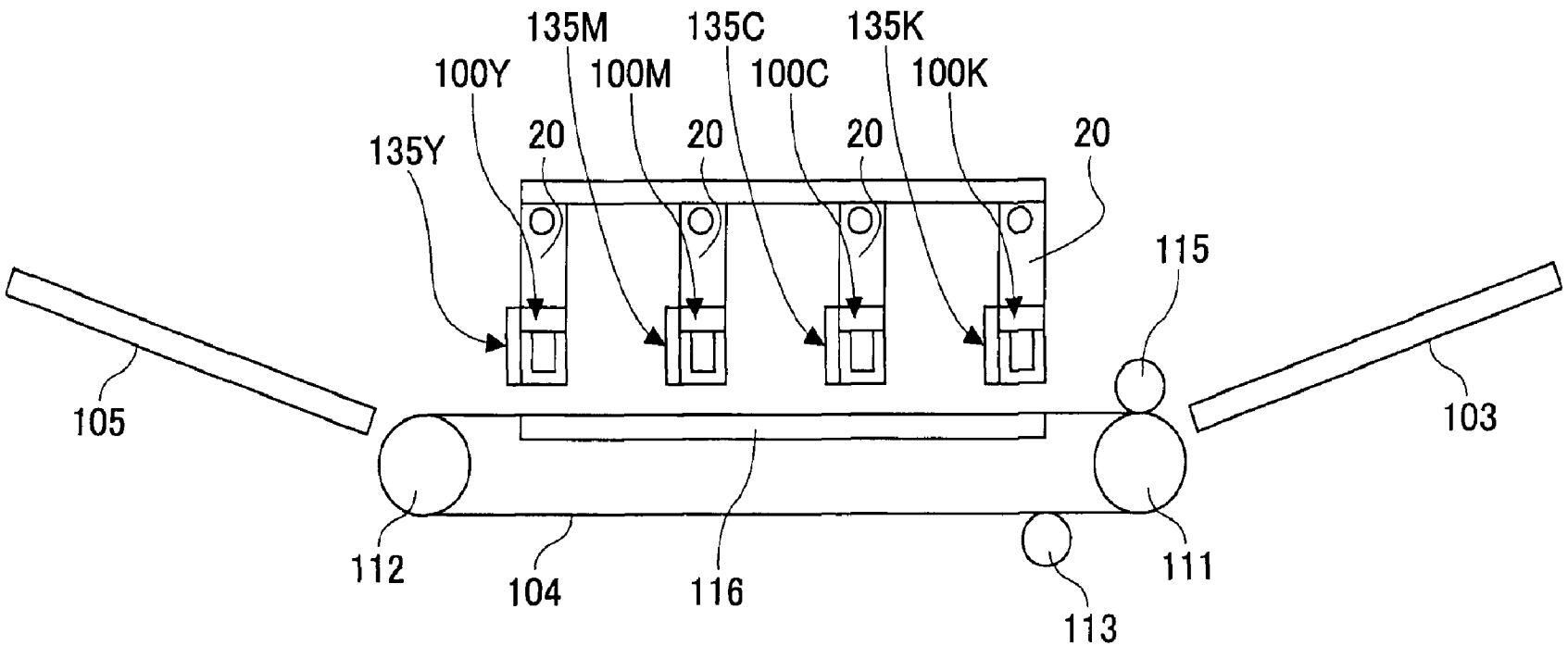
FIG. 9 is a first view for explaining a keeping and recovering operation of the image forming apparatus of the first embodiment of the present invention.
Figure 10:
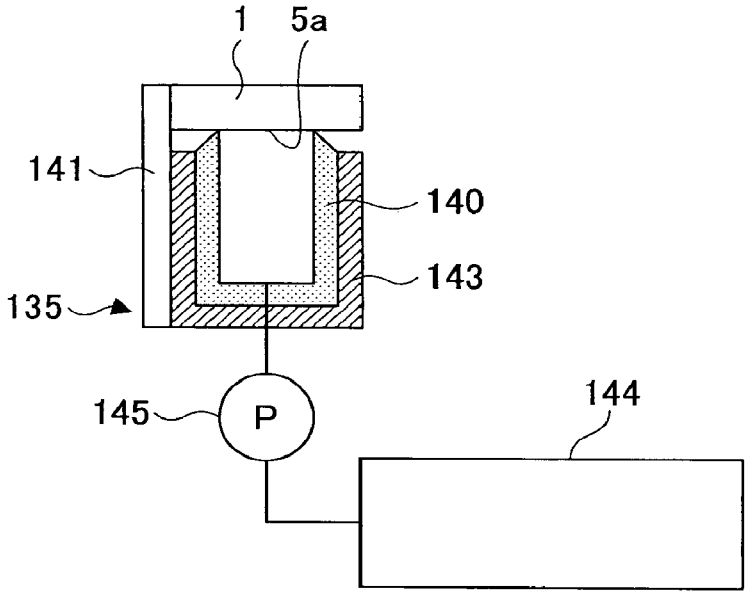
FIG. 10 is a second view for explaining the keeping and recovering operation of the image forming apparatus of the first embodiment of the present invention.
Figure 11:
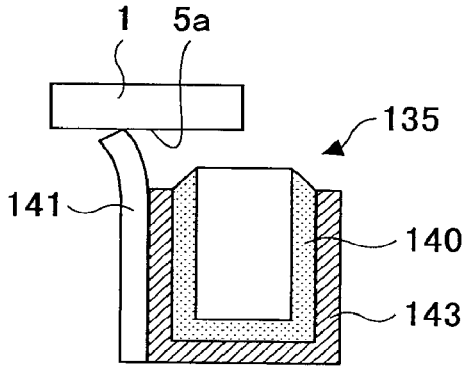
FIG. 11 is a third view for explaining the keeping and recovering operation of the image forming apparatus of the first embodiment of the present invention.

Next, a keeping and recovering operation of the image forming apparatus is discussed with reference to FIG. 9 through FIG. 11. FIG. 9 is a first view for explaining the keeping and recovering operation of the image forming apparatus of the first embodiment of the present invention. FIG. 10 is a second view for explaining the keeping and recovering operation of the image forming apparatus of the first embodiment of the present invention. FIG. 11 is a third view for explaining the keeping and recovering operation of the image forming apparatus of the first embodiment of the present invention.

When clogging or the like of the head occurs, the keeping and recovering operation of the recording head 100 is performed. First, the recording head 100 moves upward from the position shown in FIG. 1 and a keeping unit 135 moves in a horizontal direction (in a right direction from the position shown in FIG. 1) so that the keeping unit 135 is arranged just under the recording head 100 as shown in FIG. 9. The recording head 100 is slightly lowered so as to adhere to a cap 140 of the keeping unit 135.

In this state (FIG. 9), the valves V1 and V2 shown in FIG. 8 are closed and only the pump P2 is driven for a certain period of time. As a result of this, the ink in the first ink room 71 is pressed so as to flow into the recording head 100. At this time, since the valve V2 is closed, the ink is discharged from the nozzles 5 of the recording head 100. An air bubble or foreign particles which are a cause of clogging of the head 100 are discharged with the discharged ink.

After the pump P2 stops, the level of the recording head 100 is raised to a level where the recording head 100 does not contact the cap 140, and the keeping unit 135 is moved in a horizontal direction (right direction from the position shown in FIG. 9). Then, a nozzle surface of the recording head 100 is wiped by a wiper blade 141 as shown in FIG. 10. After a meniscus is formed at each of the nozzles 5 by wiping, the valve V2 is opened so that the pressure in the recording head 100 is maintained at a negative pressure corresponding to the difference "Sh" of the heads.

Since the ink discharged from the recording head 100 is collected in the cap 140, the ink is suctioned by the pump 145 so as to be discharged to a discharge tank 144. If the ink in the cap 140 is filtered by using a filter, it is possible to reuse the ink suctioned so as to return it to the second ink room 72 of the ink tank 70, not the discharge tank 144.

After that, the recording operation may be performed by elevating the recording head 100 and the horizontal movement of the keeping unit 135 to return to the operating state shown in FIG. 1, or the waiting state shown in FIG. 9 may be maintained until the next recording request is made. By this recovering operation, a clogging problem is solved and it is possible to maintain the recording head 100 in good operating condition.

Next, a temperature control method of the recording head 100 is discussed with reference to FIG. 3, FIG. 8, and FIG. 12. Here, FIG. 12 is a cross-sectional view for explaining a liquid supply tube of the image forming apparatus of the first embodiment of the present invention.

As discussed above, the temperature control fluid path 23 is formed inside the head fixing member 20 of the recording head 100. In addition, the temperature control fluid ports 15 are provided at both ends of the temperature control fluid path 23. As shown in FIG. 8, the liquid supply tube 16, made of an elastic body, is connected to the temperature control fluid port 15. The liquid supply tube 16 is connected to the temperature control fluid tank 50 via the pump P3. Because of this structure, a tube path is formed where the temperature control fluid 51 received in the temperature control fluid tank 50 can be circulated.

Figure 12:
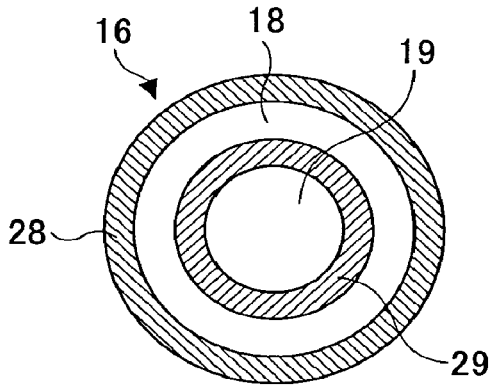
FIG. 12 is a cross-sectional view for explaining a liquid supply tube of the image forming apparatus of the first embodiment of the present invention.

The liquid supply tube 16 has a cross section of a double tube structure of an internal tube 29 and an external tube 28 as shown in FIG. 12 except at both ends of the liquid supply tube 16. A first flow path 19 is formed inside the internal tube 29. The ink 72 supplied from the ink tank 70 to the recording head 100 and discharged flows in the first flow path 19. The temperature control fluid 51 as a temperature control liquid flows in the second flow path 18 formed between the internal tube 29 and the external tube 28. The temperature control fluid 51 is supplied from the temperature control fluid tank 50 to the recording head 100 and discharged.

It is preferable that the liquid supply tube 16 be made of, for example, a resin member having elasticity or a rubber member having flexibility. By the liquid supply tube 16 having flexibility, it is possible to easily arrange the tube 16 in the apparatus (printer in this embodiment) or make connection with the recording head 100, the pump P3, the ink tank 70, and others so that arrangement of the pipes can be easily made. In addition, it is possible to move the recording head 100 connected to the liquid supply tube 16. Furthermore, since the tube for supplying the ink and the tube for controlling temperature are provided together, the pipe arrangements are not complex and it is possible to control the temperature of the ink 72 before the ink 72 is supplied to the recording head 100.

Here, the materials of the internal tube 29 and the external tube 28 composing the liquid supply tube 16 may be the same and may be different from each other depending on the kind or use of the liquids flowing inside.

For example, in a case where the fluid flowing inside the first flow path 19 is ink and water flows in the second flow path 18 for controlling the temperature of the ink or the recording head 100, a material with no eluting of components or no swelling due to the ink is selected as a material of the internal tube 29. On the other hand, since the ink does not come in contact with the external tube 28, ink-resistant properties as discussed above are not necessary. Hence, the material of the external tube 28 may have advantages in terms of other properties such as flexibility, air permeability or moisture, and cost.

In terms of temperature control of the ink, it is preferable that the material of the internal tube 29 has low heat capacity and the material of the external tube 28 has high heat capacity. With a structure where the heat capacities are different, heat exchange between the ink 72 inside the first flow path 19 and the temperature control fluid 51 in the second flow path 18 via the wall surface of the internal tube 29 can be efficiently performed. In addition, heat transfer may not be influenced by conditions outside of the external tube 28. Hence, it is possible to stably control the temperature. More specifically, a resin material such as polyethylene resin, fluorocarbon resin, polyvinyl chloride resin, or polyurethane resin or a rubber material such as fluorocarbon rubber or silicon rubber may be used as a material of the liquid supply tube 16.

In a case where oil-based ink 72 flows in the first flow path 19, water may be used as the temperature control fluid 51 flowing in the second flow path 18 because the oil-based ink has low specific heat and the temperature of the oil-based ink may not be stable. Since water has specific heat higher than that of the oil, the temperature of the oil-based ink can be made stable by surrounding the oil-based ink having the lower specific heat with water having the higher specific heat so that the temperature is controlled.

In addition, the same effect can be achieved as that when water is used for the second flow path 18 even in a case where water-based ink flows in the first flow path 19. Since the water-based ink may contain a lot of water, the difference of specific heats between the water and the water-based ink is smaller that the difference of specific heats between the water and the oil-based ink. However, the water-based ink also contains a lot of solvent having approximately half of the specific heat of the water, such as glycerine or ethylene glycol, so that the specific heat of the water-based ink is less than that of water. Accordingly, water is effective as the temperature control fluid for the water-based ink. By mixing ammonia into the water, it is possible to increase the specific heat of the temperature control fluid. By using the liquid having the high specific heat as the temperature control fluid, it is possible to make the second fluid path 18 smaller so that the liquid supply tube 16 can be thin and flexible.

In addition, in a case where the water-based ink flows in the first flow path 19, solvent such as glycerine or ethylene glycol may flow in the second flow path 18. Under this structure, the specific heat of the temperature control fluid in the second flow path 18 is less than that of the fluid in the first flow path 19. Hence, this structure is not preferable from the viewpoint of the temperature control. By flowing the liquid which may be evaporated in the second flow path 18, evaporation of the liquid in the first flow path 19 to the air can be easily prevented.

In addition, by using the liquid which may not be evaporated as the liquid in the second flow path 18, air may not be mixed in the second flow path 18. It is not necessary to connect a gas and liquid separation apparatus to the second flow path 18 so that a simple liquid supply system can be realized.

Thus, the liquid supply tube of this embodiment includes the first flow path and the second flow path. The liquid supplied from the liquid tank to the recording head flows in the first flow path. The temperature control liquid configured to control the temperature of the liquid flowing in the first flow path flows in the second flow path provided so as to surround the first flow path. Hence, it is possible to supply the temperature control liquid for controlling the temperature of the liquid jetted from the recording head with a simple structure. In addition, the temperature control liquid flows in the second flow path along the first flow path where the liquid flows so that the heat transfer can be efficiently performed. Hence, it is possible to securely control the temperatures of the liquid flowing in the first flow path and the recording head where this liquid is supplied. As a result of this, it is possible to efficiently perform temperature control of the recording head with a simple pipe structure. Hence, it is possible to effectively prevent increases of the temperature of the recording head so that stable liquid jetting properties can be maintained.

In addition, as discussed above, it is possible to efficiently control the temperature of the recording head by providing the flow path where the temperature control liquid flows in the recording head. Furthermore, supplying the temperature control liquid to the recording head is done in a body with the liquid supply tube of the liquid to be jetted from the recording head. Therefore, it is possible to make the arrangement of the pipes for supplying the liquid and the temperature control liquid simple.

Figure 13:
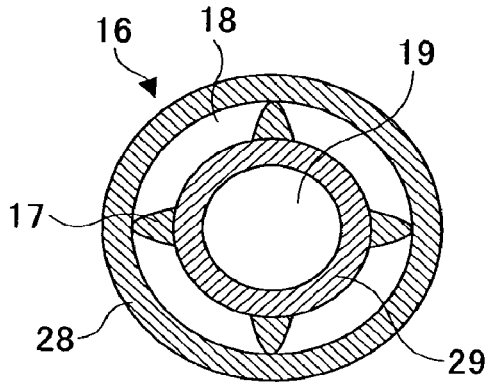
FIG. 13 is a cross-sectional view for explaining a liquid supply tube in a second embodiment of the present invention.

Next, a second embodiment of the present invention is discussed with reference to FIG. 13. Here, FIG. 13 is a cross-sectional view for explaining a liquid supply tube in the second embodiment of the present invention.

In the liquid supply tube 16 of this embodiment, ribs 17 are provided outside the internal tube 29. The ribs 17 are provided on the external wall surface as lands and in a body with the internal tube 29.

Figure 14:
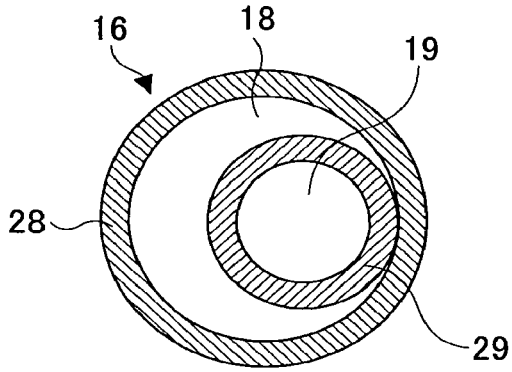
FIG. 14 is a cross-sectional view for explaining operations of the liquid supply tube.

It is possible, by providing the ribs 17 as shown in FIG. 14, to avoid the ink in the first flow 19 not being equally surrounded by the temperature control liquid in the second flow path 18 due to shifting of the internal tube 29 in the external tube 28 so that the temperature control cannot be performed equally. Here, FIG. 14 is a cross-sectional view for explaining operations of the liquid supply tube.

Thus, even if the liquid supply tube is bent in any shape, the configuration of the second flow path can be maintained by the rib members. Therefore, it is possible, where the first flow path is surrounded by the second flow path, to perform heat exchange around the entire circumference of the second flow path so that the temperature control can be performed efficiently.

In addition, in this embodiment, the ribs 17 are provided in a body with the internal tube 29*b* and the tops of the ribs 17 have circular arc-shaped configurations. Furthermore, the diameter of the most external circumference of the internal tube 29 including the ribs 17 is slightly smaller than the internal diameter of the external tube 28. Accordingly, it is possible to easily insert the internal tube 29 in the external tube 28. Furthermore, positions of the ribs 17 do not shift.

Furthermore, the tops of the ribs 17 have circular arc-shaped configurations. Hence, even if the internal tube 29 moves inside the external tube 28, the ribs 17 may not be frayed and scraped. Although the ribs 17 are provided in a body with the internal tube 29, even if the ribs 17 are provided on an internal surface of the external tube 28, the same effect can be achieved.

Figure 15:
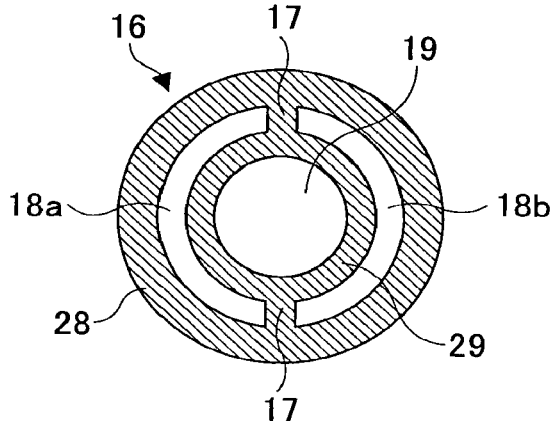
FIG. 15 is a cross-sectional view for explaining a liquid supply tube in a third embodiment of the present invention.

Next, a third embodiment of the present invention is discussed with reference to FIG. 15. Here, FIG. 15 is a cross-sectional view for explaining a liquid supply tube in the third embodiment of the present invention.

In the liquid supply tube 16 of this embodiment, the internal tube 29, the external tube 28, and the ribs 17 are formed in a body. In other words, the ribs 17 are in a body with the external surface of the internal tube 29 and the internal surface of the external tube 28, and the ribs 17 are continuously formed in a longitudinal direction of the tube 16. Hence, the second flow path 18 can be used as two independent flow paths 18*a* and 18*b*.

Furthermore, in this example, two ribs 17 are arranged on a single line and in a position halving the second flow path 18. Therefore, bending in a certain direction of the liquid supply tube 16 can be realized. In other words, it is possible to make the liquid supply tube 16 have properties where the liquid supply tube 16 can be easily bent in right and left directions and may not be bent in upper and lower directions in FIG. 15. This is proper for a case where a bending direction is a single direction and a pose (orientation) of the liquid supply tube should be kept in a direction perpendicular to the bending direction such as a case where the liquid supply tube is used as an ink supply tube of the shuttle (serial) type image forming apparatus.

In addition, in the liquid supply tube 16 of this embodiment, the thickness of the internal tube 29 is less than the thickness of the external tube 28. In the case like this embodiment where the internal tube 29 and the external tube 28 are made in a body of the same material, the heat capacity of the internal tube 29 can be made less than the heat capacity of the external tube 28 by the above-mentioned relationship of the thicknesses. With this structure, it is possible to efficiently and stably transfer the heat of the temperature control fluid in the second flow path 18 to the ink in the first flow path 19.

In the structure of the second embodiment of the present invention discussed above, the materials of the internal tube 29 and the external tube 28 may be different from each other. In this case, considering the properties such as specific heat of the material, regardless of the thicknesses of the tubes, it is possible to make the heat capacity of the internal tube 29 be less than the heat capacity of the external tube 28.

Figure 16:
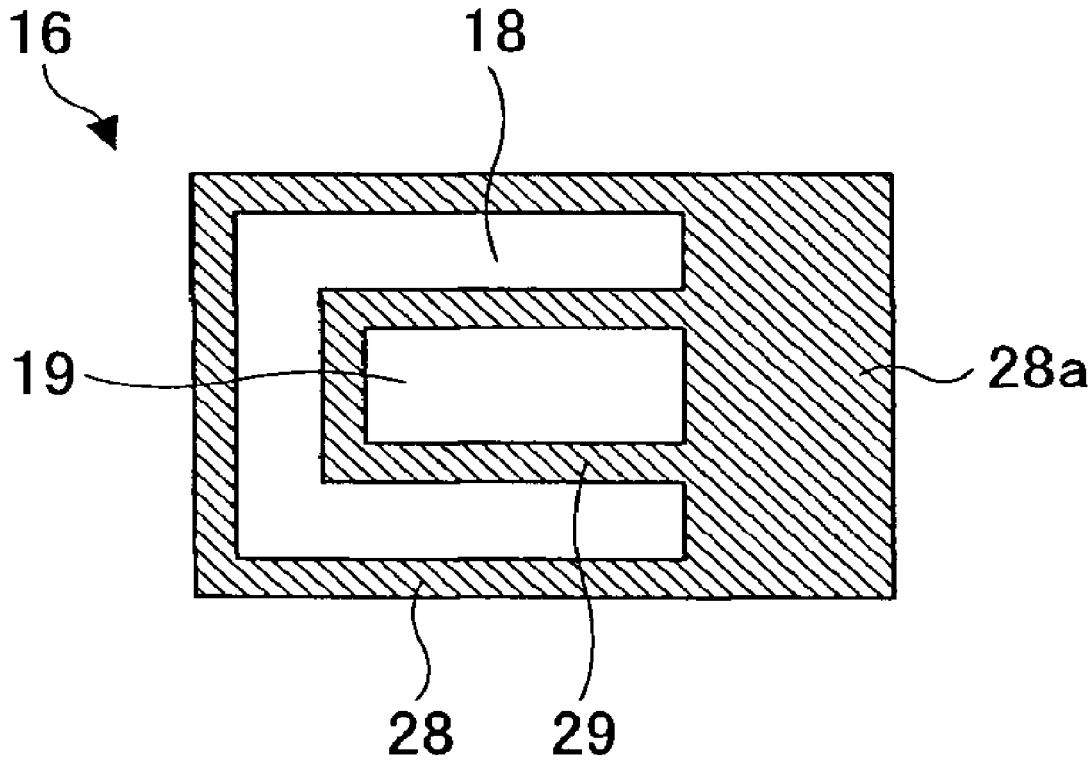
FIG. 16 is a cross-sectional view for explaining a liquid supply tube in a fourth embodiment of the present invention.

Next, a fourth embodiment of the present invention is discussed with reference to FIG. 16. FIG. 16 is a cross-sectional view for explaining a liquid supply tube in a fourth embodiment of the present invention.

In the above-discussed embodiments, the liquid supply tube 16 has a circular configuration. In this embodiment, the liquid supply tube 16 has a rectangular-shaped cross-sectional configuration. That is to say, in the liquid supply tube 16 of this embodiment, the first flow path 19 is a rectangular tube having a rectangular-shaped configuration and the first flow path 19 is surrounded on three sides by the second flow path 18 having a rectangular-shaped configuration without one side. In this case, the periphery of the first flow path 19 is not completely surrounded by the second flow path 18. However, at a part 28*a* which is not surrounded by the second flow path 18, the thickness of the external tube 28 is greater than that of other parts. Therefore, it is difficult for heat to be exchanged with the outside.

Thus, even if the first flow path 19 is not completely surrounded by the second flow path 18, as long as an adiabatic structure is formed, it is possible to efficiently control the temperature of the liquid flowing in the internal tube 29.

In the above-discussed embodiments, the liquid supply tube 16 has a double tube structure. However, the liquid supply tube 16 may have, if necessary, a structure with three or more tubes. In addition, in the above-discussed embodiments, the double tube structure is applied to the entire length of the liquid supply tube 16. However, for example, in a case where the temperature control fluid tank 50 and the ink tank 70 are separately provided, only a part near the recording head 100 may have a double tube structure.

Figure 17:
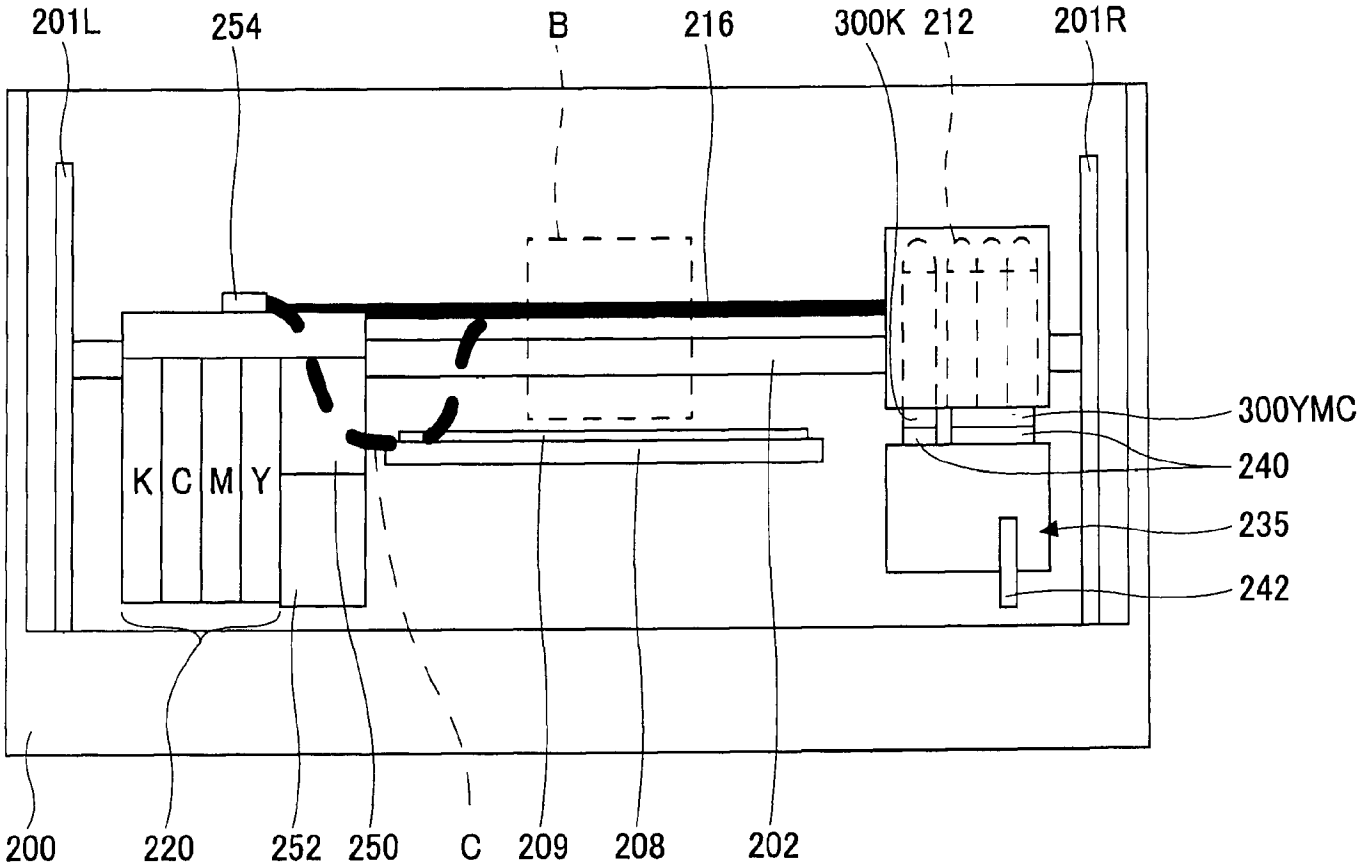
FIG. 17 is a front view of an image forming apparatus of a fifth embodiment of the present invention.
Figure 18:
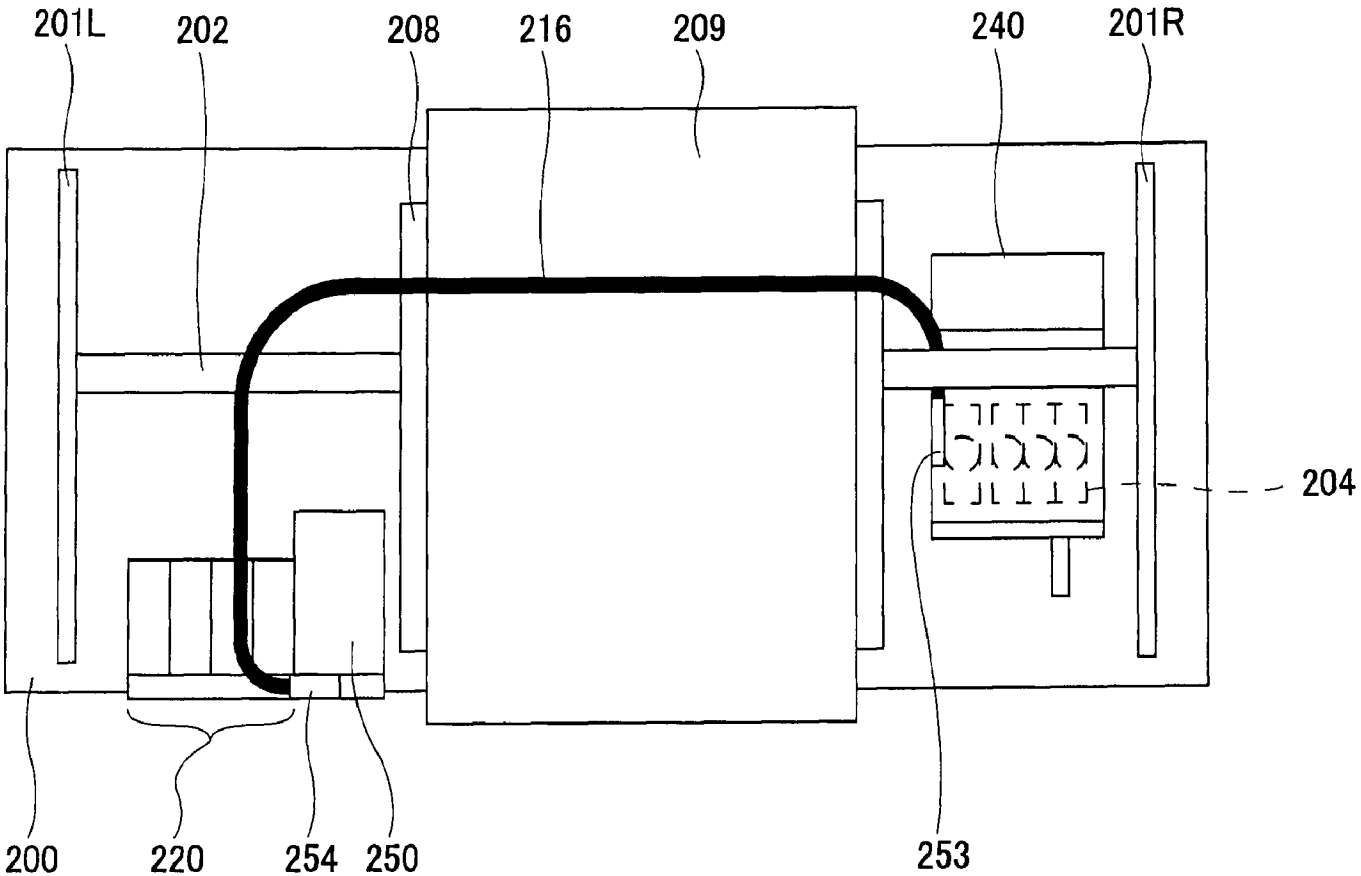
FIG. 18 is a plan view of the image forming apparatus of the fifth embodiment of the present invention.
Figure 19:
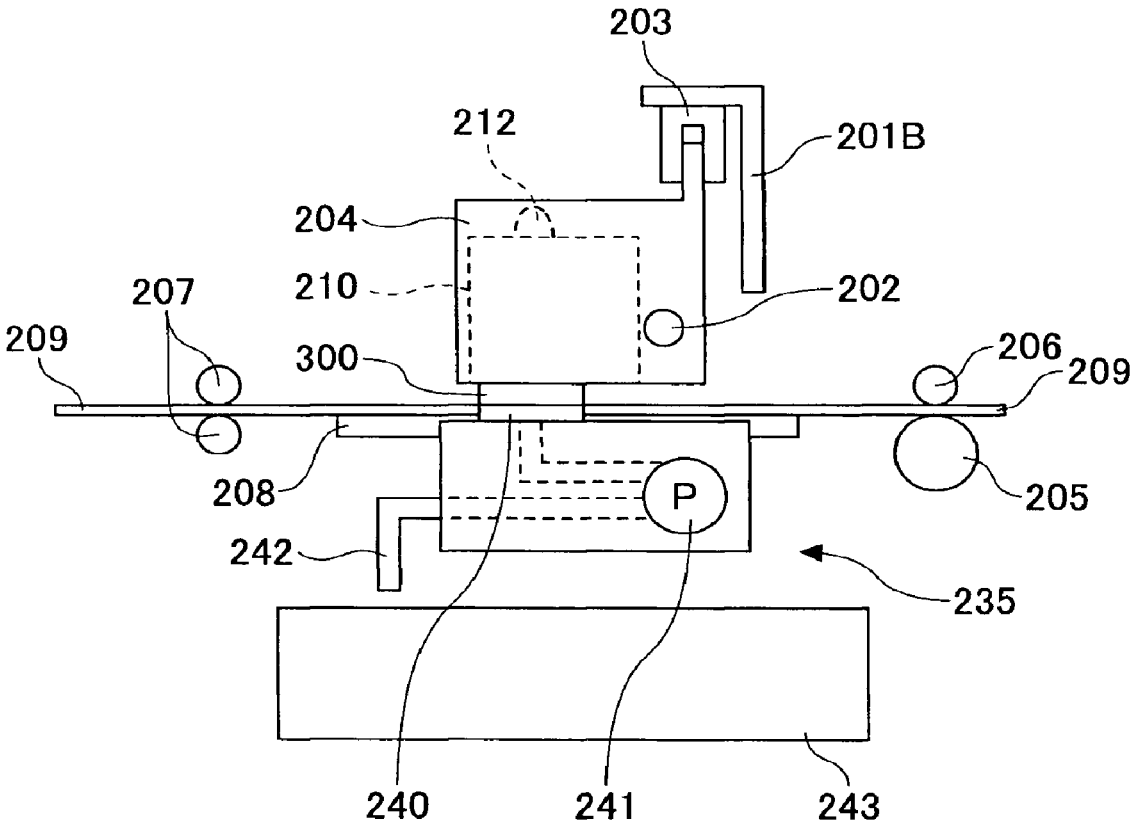
FIG. 19 is a right side view of the image forming apparatus of the fifth embodiment of the present invention.

Next, an image forming apparatus of a fifth embodiment of the present invention is discussed with reference to FIG. 17 through FIG. 19. Here, FIG. 17 is a front view of the image forming apparatus of the fifth embodiment of the present invention. FIG. 18 is a plan view of the image forming apparatus of the fifth embodiment of the present invention. FIG. 19 is a right side view of the image forming apparatus of the fifth embodiment of the present invention.

The image forming apparatus of the fifth embodiment of the present invention is a serial (shuttle) type. In this image forming apparatus, a carriage 204 is held by a guide rod 202 and a guide rail 203 so that the carriage 204 can be slid in a main scanning direction (guide rod longitudinal direction). The guide rod 202 is a guide member provided between left and right side plates 201L and 201R arranged on a main frame 200. The guide rail 203 is provided at the rear plate 201B (see FIG. 19). The carriage 204 is moved and scanned in a longitudinal direction (main scanning direction) of the guide rod 202 by a main scanning motor and a timing belt (not shown).

In this carriage 204, a recording head 300 is provided so that plural ink jet openings are arranged in a direction perpendicular to a main scanning direction and an ink drop jetting direction is downward. The recording head 300 is configured to jet ink drops of colors yellow (Y), magenta (M), cyan (C) and black (Bk). As a liquid jet head forming the recording head 300 as well as the liquid jet head 1, a thermal type head is used. In the thermal type head, heat is generated by sending an electrical current to an electric heat conversion element so that ink is foamed due to the heat so that the ink is jetted. In this example, a recording head 300 YMC is configured to jet ink drops of colors YMC and a recording head 300K is configured to jet ink drops of color K.

A paper 209 is conveyed under the carriage 204 in a main scanning direction and a sub-scanning direction perpendicular to the main scanning direction. An image is formed on the paper 209. As shown in FIG. 19, the paper 209 is sandwiched by a conveyance roller 205 and a pressing roller 206 and conveyed to an image forming part (printing part) of the recording head 300 and then a printing guide part 208. Scanning of the carriage 204 in the main scanning direction and ink jetted from the recording head 300 go with each other, depending on image data, at a proper timing, so that one band of an image is formed on the paper 209. After the one band of the image is formed, the paper 209 is conveyed in the sub-scanning direction by a designated amount so that the same recording operation is performed. These operations are repeated so that one page of an image is formed. Then, the paper 209 is discharged by discharge rollers 207.

On the other hand, a sub-tank 210 (see FIG. 19) is connected to an upper part of the recording head 300. The sub-tank 210 has an ink room configured to store the ink to be jetted for a while. The liquid supply tube 216 is connected to the ink room and in communication with the ink cartridge 220 as a liquid tank.

A filter (not shown) is provided inside the sub-tank 210. The ink which is filtered so that foreign particles are removed is supplied to the recording head 300. In addition, a damper member 212 (see FIG. 17) made of an elastic member is provided on a top surface of the sub-tank 210. The inside of the damper member 212 is in communication with the ink room of the sub-tank 210 so that pressure change inside of the ink room based on the main scanning operation of the carriage 204 is absorbed by the damper member 212.

In addition, the image forming apparatus of this embodiment includes a keeping and recovering mechanism 235 configured to maintain and recover the recording head 300. The keeping and recovering mechanism 235 includes a cap member 240, a suction pump 241, a discharge path 242 of the suction pump 241, a discharge liquid tank 243, and others. The cap member 240 is configured to cap nozzle surfaces of the recording head 300. The suction pump 241 is configured to take suction on the inside of the cap member 240. The discharge liquid tank 243 is configured to receive the discharged liquid.

Figure 20:
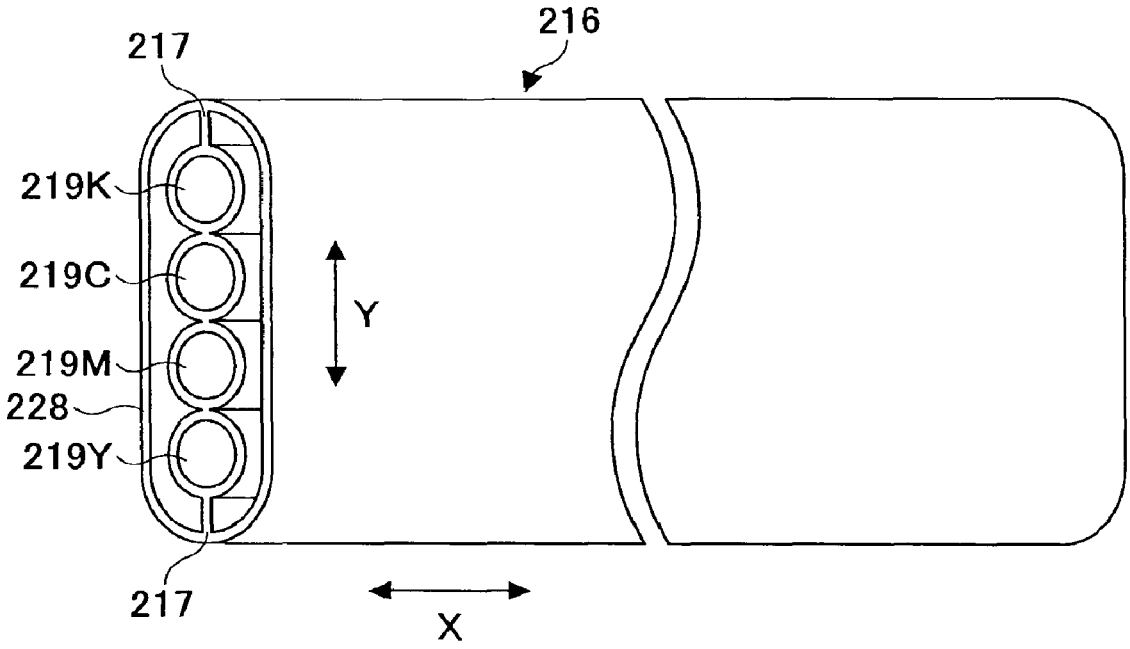
FIG. 20 is a schematic and perspective view of a liquid supply tube of the image forming apparatus of the fifth embodiment of the present invention.
Figure 21:
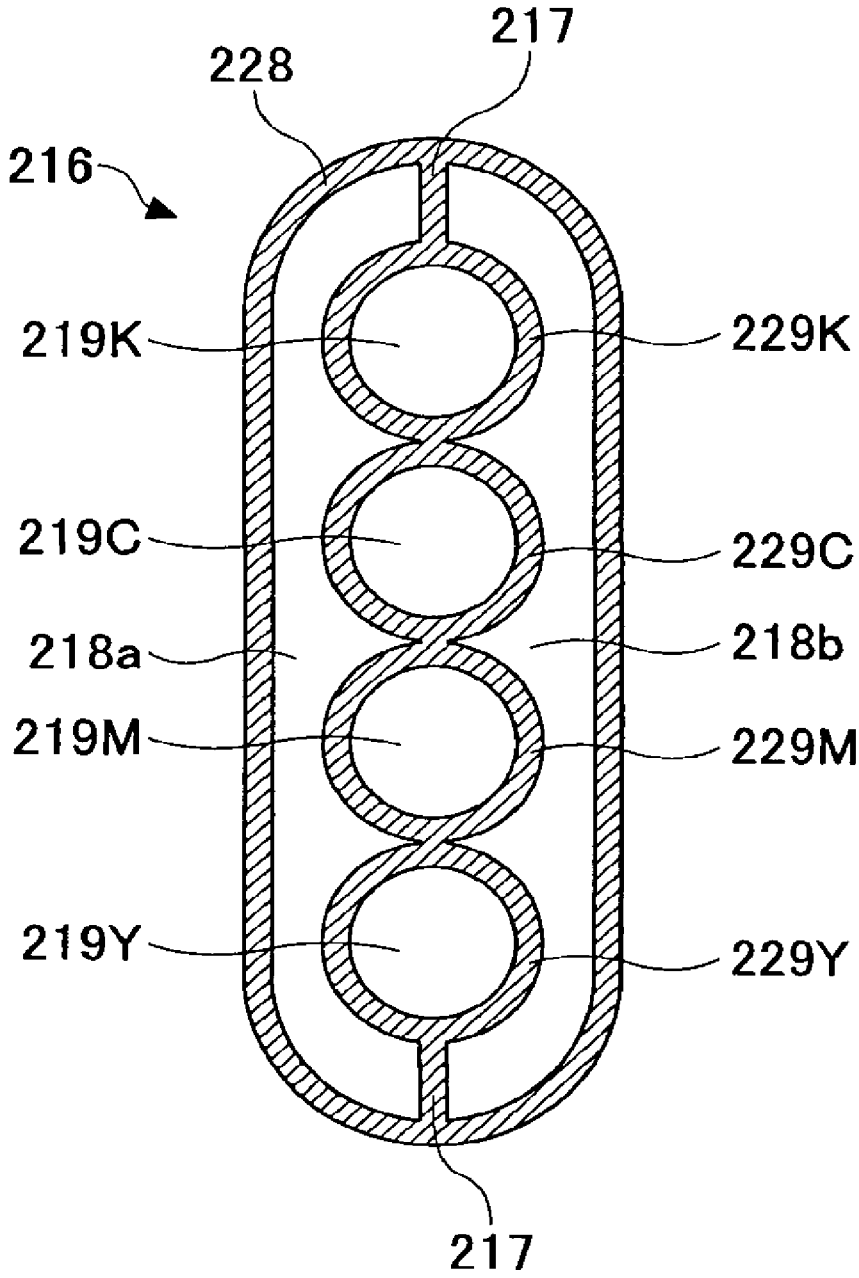
FIG. 21 is a cross-sectional view of the liquid supply tube of the image forming apparatus of the fifth embodiment of the present invention.

Next, the liquid supply tube 216 of this image forming apparatus is discussed with reference to FIG. 20 and FIG. 21. FIG. 20 is a schematic and perspective view of the liquid supply tube 216 of the image forming apparatus of the fifth embodiment of the present invention. FIG. 21 is a cross-sectional view of the liquid supply tube 216 of the image forming apparatus of the fifth embodiment of the present invention.

The liquid supply tube 216 has a double tube structure where four internal tubes 229 are provided inside the external tube 228. The external tube 228 has an oblate configuration. Four internal tubes 229 (229K, 229C, 299M and 229Y) are arranged in a straight line. The ribs 217 are formed, in a body with the internal tubes 229 and the external tube 218, at both end parts in an arrangement direction of the internal tubes 229 between the internal tubes 229 and the external tube 228. With this structure, a space between the internal tubes 229 and the external tube 228, namely the second flow path 218, is bisected so that two second flow paths 218*a* and 218*b* are formed.

Figure 22:
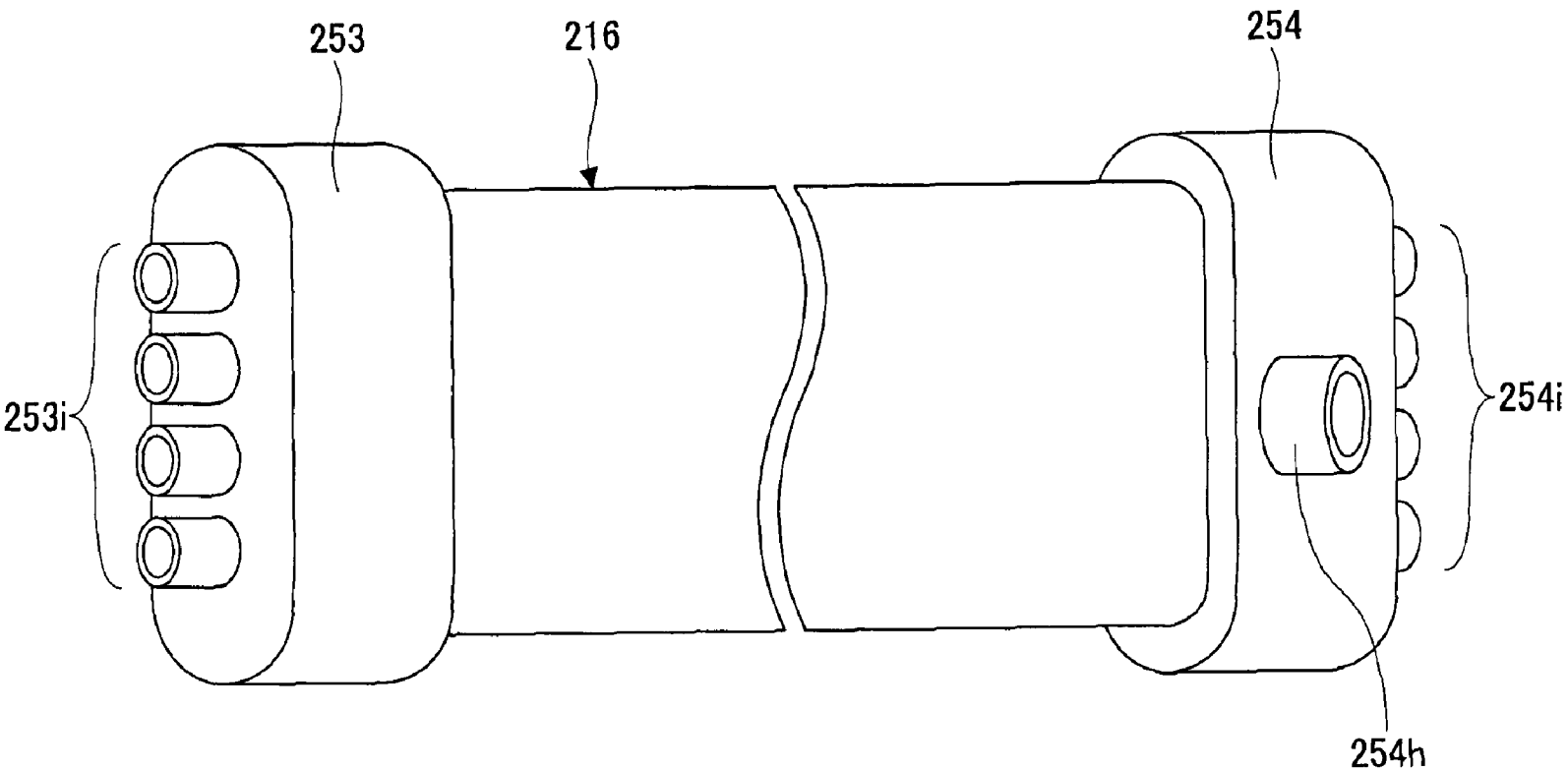
FIG. 22 is a schematic and perspective view showing a connected joint.

One end of the liquid supply tube 216 is connected to the joint 254 as shown in FIG. 22. The joint 254 includes an ink communicating part 254*i* and temperature control fluid communicating parts 254*h*. The ink communicating part 254*i* is connected to the four internal tubes 229 (229K, 229C, 229M, and 229Y) of the liquid supply tube 216. The temperature control fluid communicating parts 254*h* are connected to the external tube 228. There are two temperature control fluid communicating parts 254*h* which are situated corresponding to the second flow paths 218*a* and 218*b*. As shown in FIG. 18, the temperature control fluid communicating parts 254*h* are connected to the temperature control fluid tank 250. A temperature control apparatus 252 (see FIG. 17) is provided at the temperature control fluid tank 250 so as to control the temperature of the temperature control fluid. Here, FIG. 22 is a schematic and perspective view showing the connected joint 254.

On the other hand, the joint 253 is connected to the other end of the liquid supply tube 216. The ink communicating part 253*i* is provided at the joint 253 as well as the ink communicating part 254*i* provided at the joint 254. The ink communicating part 253*i* is in communication with the four internal tubes 229 (229K, 229C, 229M, and 229Y) of the liquid supply tube 216.

Figure 23:
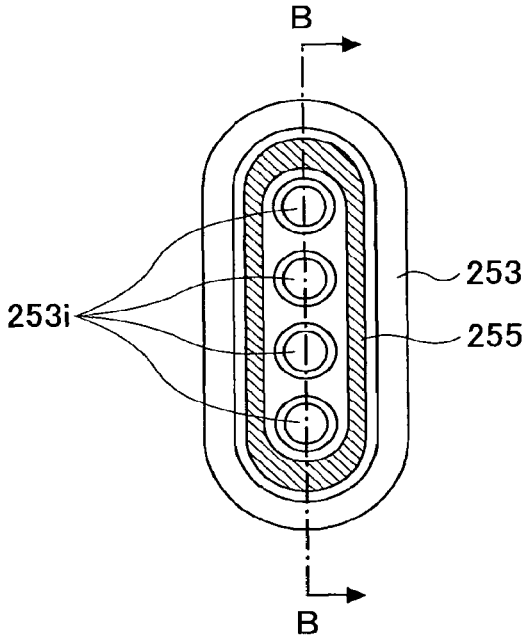
FIG. 23 is a side view of a liquid supply tube connecting side of the joint.
Figure 24:
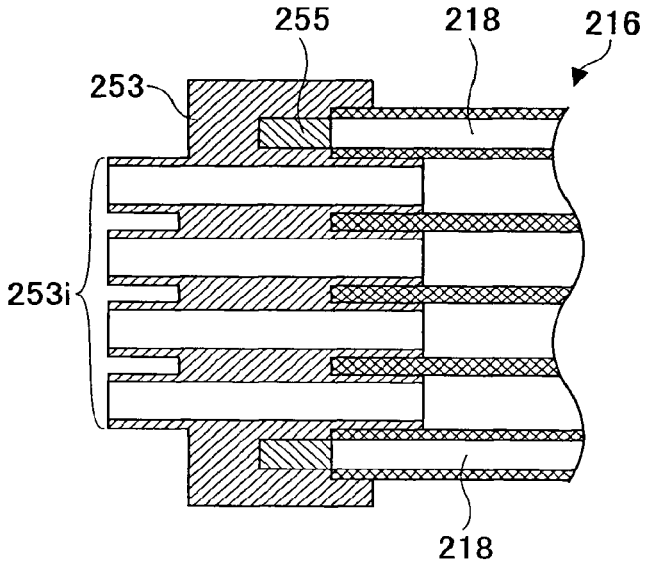
FIG. 24 is a cross-sectional view taken along a line B-B of FIG. 23.

Here, FIG. 23 and FIG. 24 show the joint 253 connected to the liquid supply tube 216. FIG. 23 is a side view of the liquid supply tube 216 connecting side of the joint 253. FIG. 24 is a cross-sectional view taken along a line B-B of FIG. 23.

A groove 255 which is hatched in FIG. 23 is formed in the joint 253 in the vicinity of the head end part of the second flow path 18 of the liquid supply tube 216. With this structure, two second flow paths 218*a* and 218*b* separated by the rib 217 as shown in FIG. 21 are in communication with the groove 255. For example, it is possible to make the temperature control fluid, flowing in the second fluid path 218*b* from the temperature control fluid tank 250, take a U-turn to the second fluid path 218*a* by the groove 255 so that the temperature control fluid can be returned to the temperature control fluid tank 250 via the second fluid path 218*a*.

Figure 25:
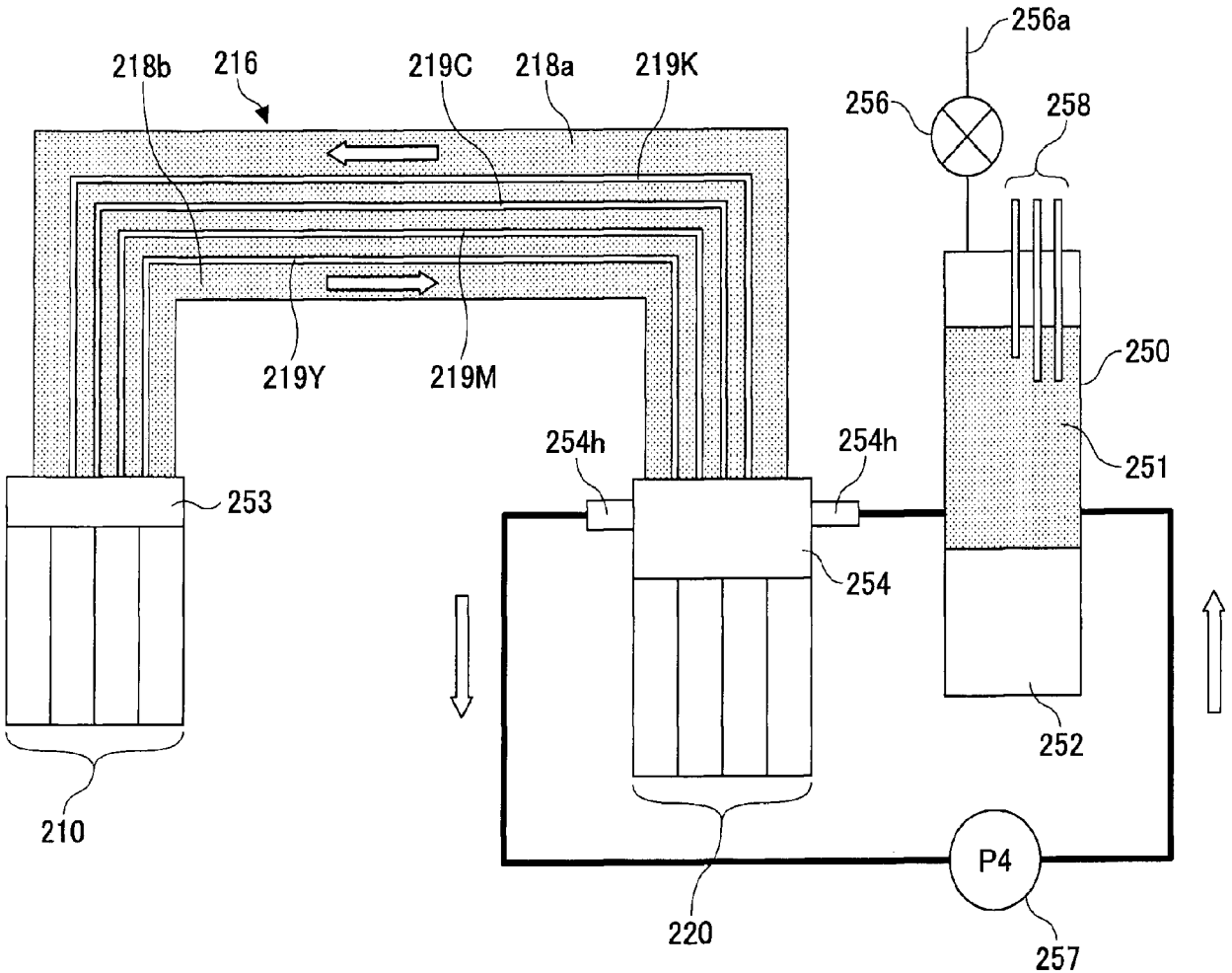
FIG. 25 is a schematic view of a supply path of the ink and temperature control liquid in the image forming apparatus of the fifth embodiment of the present invention.

Next, a supply system of the ink and the temperature control fluid of the image forming apparatus is explained with reference to FIG. 25. FIG. 25 is a schematic view of a supply path of the ink and temperature control liquid in the image forming apparatus of the fifth embodiment of the present invention.

Temperature control of plural kinds of ink in the liquid supply tube 216 while the temperature control liquid is circulated by the pump 257 can be performed by a single tube. Under this structure, the ink is supplied. Therefore, by heating the temperature control fluid with, for example, the temperature control device 252, while the temperature of the ink flowing in the internal tubes 229 of the tube 216 is kept high, it is possible to send the ink to the carriage part with low viscosity and low resistance.

Control of the temperature of the ink in the tube with circulating liquid can be realized by the liquid supply tube 16 having the structure shown in FIG. 12, FIG. 13 and FIG. 15. However, by using the liquid supply tube 216 shown in FIG. 20, it is possible to realize a function for controlling the temperatures of plural kinds of liquids and sending them by a single tube. Accordingly, it is possible to simplify the arrangement of the tubes.

Thus, with a structure where the ribs are continuously formed in the second flow path so that the second flow path is divided into plural parts, it is possible to make the flow of the temperature control liquid constant so that the temperature control properties become stable. In addition, the temperature control liquid flows divided plural second flow paths in different directions. As a result of this, it is possible to control temperature of the temperature control liquid with a simple structure while the temperature control liquid is circulated. In addition, the arrangement of the pipes can be simplified.

An air opening valve 256 is provided in the temperature control fluid tank 250. The air opening valve 256 is configured to open and close an air communicating path 256*a* in communication with the air. In a case where the temperature of the temperature control fluid of the temperature control fluid tank 250 is changed by the temperature control apparatus 252, by opening the air opening valve 256 so that the inside of the tank 250 is opened to the air, it is possible to keep the inside pressure of the tank 259 constant so that the temperature can be securely controlled. Furthermore, the air mixed in the second path 218 of the liquid supply tube 216 with time can be discharged. Hence, it is possible to perform the temperature control stably.

The air in the temperature control fluid tank 250 can be detected by various methods. In this embodiment, electrode sensors 258 are provided in the temperature control fluid tank 250. The electrode sensors 258 are situated at different depth positions. The electrode sensors 258 are configured to detect the air based on the electric resistance among the electrodes 258. In addition to this example, for example, as long as at least a part of the upper part of the temperature control fluid tank 250 is made of a transparent material, an optical method using a photo sensor can be used. When the air entering the temperature control fluid tank 250 is stored, this is reported to the user. If the temperature control fluid is supplied to the temperature control fluid tank 250 where the air opening valve 256 is opened, it is possible to simultaneously perform the discharge of the air from the air opening valve 256. Therefore, it is possible to operate the apparatus stably without degradation of the temperature control function.

If the other tank receiving the temperature control fluid and a pump configured to send the temperature control fluid inside are provided at the temperature control fluid tank 250, it is possible to automatically perform supplying the temperature control fluid and air bubble discharge together with the sensor 258.

In addition, in this embodiment, as shown in FIG. 20, plural internal tubes 229 are arranged in a single line and the ribs 217 are formed in the arrangement direction in a body so that an oblate structure is formed. Therefore, properties of easily bending in a single direction are obtained. In other words, bending is easily done in the X direction and is not easily done in the Y direction of FIG. 20. Accordingly, in a case where the above-discussed structure is provided in the shuttle type inkjet recording apparatus, by properly selecting the pose of the liquid supply tube 216 (the Y direction of the liquid supply tube 216 is upper and lower directions) in the structure of the apparatus in this embodiment, the liquid supply tube 216 can be freely bent based on the movement of the carriage 204. The liquid supply tube 216 may be bent in a direction (Y direction of FIG. 20) perpendicular to the bending direction. Therefore, in a case where, for example, the carriage 204 is situated in a position indicated by a dotted line B of FIG. 17, the liquid supply tube 216 may not hang down as indicated by a dotted line C and the tube 216 may not come in contact with a non-proper part.

According to the embodiments of the present invention, it is possible to provide an image forming apparatus including a recording head configured to jet a liquid; a liquid tank configured to store the liquid; and a supply tube having flexibility, the supply tube being provided between the liquid tank and the recording head, wherein the supply tube includes a first flow path through which the liquid flows from the liquid tank to the recording head, and a second flow path surrounding the first flow path, the second flow path being a path through which a temperature control liquid flows, the temperature control liquid controlling a temperature of the liquid flowing through the first flow path.

In short, a first flow path through which the liquid flows from the liquid tank to the recording head, and a second flow path surrounding the first flow path, the second flow path being the path through which temperature control liquid flows, the temperature control liquid controlling a temperature of the liquid flowing in the first flow path, are provided in the image forming apparatus of the embodiments of the present invention.

Under this structure, it is possible to supply the temperature control liquid controlling the temperature of the liquid to be jetted from the recording head, with a simple structure. Therefore, temperature control of the recording head can be performed with a simple pipe structure and high efficiency. Hence, increase of temperature of the head can be effectively prevented and stable liquid jet properties can be maintained.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of superiority or inferiority of the invention. Although the embodiment of the present invention has been described in detail, it should be understood that the various changes, substitutions, and alterations could be made hereto without departing from the spirit and scope of the invention.

This patent application is based on Japanese Priority Patent Application No. 2008-57348 filed on Mar. 7, 2008, the entire contents of which are hereby incorporated herein by reference.

What is claimed is:

1. An image forming apparatus, comprising:
a recording head configured to jet a liquid;
a liquid tank configured to store the liquid; and
a supply tube having flexibility, the supply tube being provided between the liquid tank and the recording head,
wherein the supply tube includes
a first flow path through which the liquid flows from the liquid tank to the recording head; and
a second flow path through which a temperature control liquid flows, the temperature control liquid controlling a temperature of the liquid flowing through the first flow path, the second flow path surrounding the first flow path and being divided into a plurality of separate flow paths by a rib member so that the temperature control liquid flows in a first one of the separate flow paths in a first direction and flows in a second one of the separate flow paths in a second direction opposite to the first direction.

2. The image forming apparatus as claimed in claim 1,
wherein a temperature control path is provided inside the recording head; and
the temperature control liquid is supplied from the supply tube to the temperature control path.

3. The image forming apparatus as claimed in claim 1,
wherein the rib member is provided between the first flow path and the second flow path of the supply tube in a body with a partition configured to separate the first flow path and the second flow path or a partition configured to separate the second flow path and an external circumferential surface, the rib member being configured to support he first flow path against the second flow path.

4. The image forming apparatus as claimed in claim 3,
wherein the rib member is continuously formed in a longitudinal direction the supply tube.

5. The image forming apparatus as claimed in claim 1,
wherein there are plural ones of the first flow paths of the supply tube.

6. The image forming apparatus as claimed in claim 1,
wherein a specific heat of the temperature control liquid flowing through the second flow path is greater than a specific heat of the liquid flowing through the first flow path.

7. The image forming apparatus as claimed in claim 1,
wherein heat capacity of a member forming the second flow path is greater than heat capacity of a member forming the first flow path.

8. The image forming apparatus as claimed in claim 1, further comprising:
a temperature control liquid tank configured to store the temperature control liquid, wherein
the temperature control liquid tank includes an air communicating path, and
the air communicating path communicates with air and is configured to be opened and closed.

* * * * *